US005900853A

United States Patent [19]

Shimizu et al.

[11] Patent Number: 5,900,853

[45] Date of Patent: May 4, 1999

[54] SIGNAL LINE DRIVING CIRCUIT

[75] Inventors: Kan Shimizu, Urawa; Akira Masuko, Tokyo; Yoshimasa Adachi, Fujisawa, all of Japan

[73] Assignee: Kabushiki Kaisha Toshiba, Kawasaki, Japan

[21] Appl. No.: 08/821,915

[22] Filed: Mar. 21, 1997

[30] Foreign Application Priority Data

Mar. 22, 1996 [JP] Japan ..... 8-066797

[51] Int. Cl.[6] ..... G09G 3/36

[52] U.S. Cl. ..... 345/98; 345/100

[58] Field of Search ..... 345/100, 98, 88; 377/98

[56] References Cited

U.S. PATENT DOCUMENTS

| | | | |
|---|---|---|---|
| 5,282,234 | 1/1994 | Murayama et al. | 377/78 |
| 5,623,279 | 4/1997 | Itakura et al. | 345/100 |
| 5,648,792 | 7/1997 | Sado et al. | 345/100 |
| 5,682,175 | 10/1997 | Kitamura | 345/98 |

FOREIGN PATENT DOCUMENTS 5-5114 1/1993 Japan .

7-40178 5/1995 Japan .

*Primary Examiner*—Matthew Luu

*Attorney, Agent, or Firm*—Pillsbury Madison & Sutro LLP

[57] ABSTRACT

A signal line driver is used for a liquid crystal display device including a matrix array of 230×720 pixels arranged in a predetermined color order for each row, 230 scanning lines for selecting the row of the pixels, and 720 signal lines for setting the potentials of the pixels of the selected row. The signal line driver has three bus lines for receiving color video signals of three primary colors. Particularly, the signal line driver includes 721 sample-hold circuits divided into a plurality of groups and connected to the bus lines based on the color order of the pixels on a corresponding row, for sequentially sampling and holding the color video signals on the bus lines, 720 selection switches for selecting one of the groups of the sample-hold circuits according to the selected row of the pixels and allocating output voltages of the sample-hold circuits of the selected group to the 720 signal lines, and a control circuit for controlling the sample-hold circuits and the selection switches each time the selected row of the pixels is updated.

8 Claims, 6 Drawing Sheets

SIGNAL LINE DRIVING CIRCUIT

BACKGROUND OF THE INVENTION

This invention relates to a flat-panel display device of a matrix type, and particularly to and a signal line driving circuit for driving signal lines of the flat-panel display device such as a liquid crystal display device.

For example, Jpn. Pat. Appln. KOKOKU Publication No. 7-40178 and Jpn. Pat. Appln. KOKOKU No. 5-5114 disclose a liquid crystal display device having a matrix type liquid crystal panel for displaying images for television broadcasting in a colored form. The liquid crystal panel has a matrix array of pixels, a plurality of scanning lines extending in a horizontal direction along the rows of the pixels, a plurality of signal lines extending in a vertical direction along the columns of the pixels, and a plurality of color filters covering the pixels. The pixels of each row have pixel electrodes which are charged by signal voltages applied to the respective signal lines while the pixels are being selected by a corresponding one of the scanning lines and the distribution of the light transmittance of the liquid crystal in the screen is controlled by the potentials of the pixel electrodes. The color filters are constructed by filters of three primary colors of red, green and blue arranged in regular color order in the horizontal direction and selectively transmit lights of specified wave lengths.

The liquid crystal display device has a signal line driver for driving the signal lines of the liquid crystal panel according to color video signals of red (R), green (G) and blue (B) derived by demodulating a video signal of television broadcasting form. The signal line driver has three bus lines for transmitting the RGB color video signals, and a plurality of sample-hold circuits which are connected to the three bus lines in regular order. The sample-hold circuits sequentially sample and hold RGB color video signals in one horizontal scanning period and output signal voltages to the signal lines after the whole sample-hold operation is completed.

The horizontal arrangement of the color filters does not necessarily mean that all of the pixels on the same column are covered with the filters of the same color. For example, the pixels on the first column are respectively covered with the color filters arranged in color order of RBRB - - - or BRGBRG - - - in the vertical direction. In the former case, the pixels on the first row are respectively covered with the color filters arranged in color order of RGBRGB - - - , the pixels on the second row are respectively covered with the color filters arranged in color order of BRGBRG - - - , and the pixels on the third and fourth rows, on the fifth and sixth rows, are covered with the color filters arranged in the same manner as described above.

Since the above positional relation lies between the pixels and the color filters, it becomes necessary to supply different color video signals to the respective signal lines as the row of the pixels to be selected by use of the scanning line is changed. To meet the above requirement, a switching unit comprising switches such as Field Effect Transistors (FETs) for switching the RGB color video signals supplied to the three bus lines is provided in the signal line driver.

In the above construction, the RGB color video signals are supplied to the sample-hold circuits via the bus lines from the switching unit. For example, if 100 sample-hold circuits are connected to each bus line, the bus line may have a stray capacitance of a relatively large value, for example, approx. 20 pF. The stray capacitance of the bus line and the output impedance of the switch constitute a low-pass filter. If the number of pixels is increased to enhance the resolution of the liquid crystal display device, it becomes necessary to reduce the output impedance of the switching unit so as to supply a signal of wide bandwidth to each sample-hold circuit.

To reduce the output impedance, for example, one may enlarge the gate width of a field effect transistor used for the switch. However, since this scheme increases the stray capacitance of the switch to be charged and discharged upon driving of the bus line, the power consumption is increased even under the same voltage and same frequency. Further, the bandwidth of a low-pass filter constructed by the stray capacitance of the switch and the output impedance of an RGB color video signal source is narrowed.

In order to prevent the bandwidth from being narrowed, it is necessary to further reduce the output impedance of the RGB color video signal source. For example, if the stray capacitance including the stray capacitance of the switching unit is increased by 1.5 times when an attempt is made to double the bandwidth by reducing the output impedance of the switching unit, it becomes necessary to lower the output impedance of the RGB color video signal source to one-third.

With the conventional signal line driver, since an increase in the number of pixels increases the stray capacitance which prevents the enlargement of the bandwidth or enhancement of the speed of the RGB color video signals, the power consumption is inevitably increased with an increase in the operation speed of the signal line driver.

BRIEF SUMMARY OF THE INVENTION

An object of this invention is to provide a signal line driving circuit which is designed by taking the above conventional problem into consideration and constructed to be operated at high speed without significantly increasing the power consumption.

The above object can be attained by a signal line driving circuit for a flat-panel display device including a matrix array of pixels arranged in a predetermined color order for each row, a plurality of scanning lines for selecting the row of the pixels, and a plurality of signal lines for setting the potentials of the pixels of the selected row, comprising a plurality of bus lines for receiving a plurality of color video signals; a plurality of sample-hold circuits divided into a plurality of groups each connected to the bus lines according to the color order of the pixels on the corresponding row to sequentially sample and hold the color video signals on the bus lines; a selecting section for selecting one of the groups of the sample-hold circuits corresponding to a selected row of the pixels and respectively allocating output voltages of the sample-hold circuits of the selected group to the plurality of signal lines; and a control section for controlling the plurality of sample-hold circuits and the selecting section each time the selected row of the pixels is updated.

In the above signal line driving circuit, the groups of sample-hold circuits perform an operation of sequentially sampling and holding three primary color video signals on the bus lines. The selecting section selects one of the groups of the sample-hold circuits corresponding to the selected row of the pixels and respectively allocates output voltages of the sample-hold circuits of the selected group to the signal lines. That is, since the primary color video signals are respectively supplied to the bus lines corresponding to the three primary colors without passing through a switching unit, unlike the conventional case, it becomes possible to prevent low-pass filters from being constructed by stray capacitances of the bus lines and the output impedance of the switching unit. As a result, the signal line driving circuit can be operated at high speed without significantly increasing power consumption.

Further, since the signal source of each color video signal is only required to have a driving ability for driving the sample-hold circuit array and the stray capacitance of a corresponding bus line which does not include the stray capacitance of the switching unit as a load, the power consumption of the signal source can be reduced.

The selecting section is constructed to perform the selecting operation once each time the selected row of the pixels is updated and allocate output voltages of the sample-hold circuits of the selected group to the signal lines. That is, it is not necessary to frequently charge or discharge the stray capacitance of the selecting section, although the power consumption of the selecting section may increase.

Additional objects and advantages of the invention will be set forth in the description which follows, and in part will be evident from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and, together with the general description given above and the detailed description of the preferred embodiments given below, serve to explain the principles of the invention.

DETAILED DESCRIPTION OF THE INVENTION

A liquid crystal display device according to a first embodiment of this invention will now be described with reference to the accompanying drawings.

Figure 1:
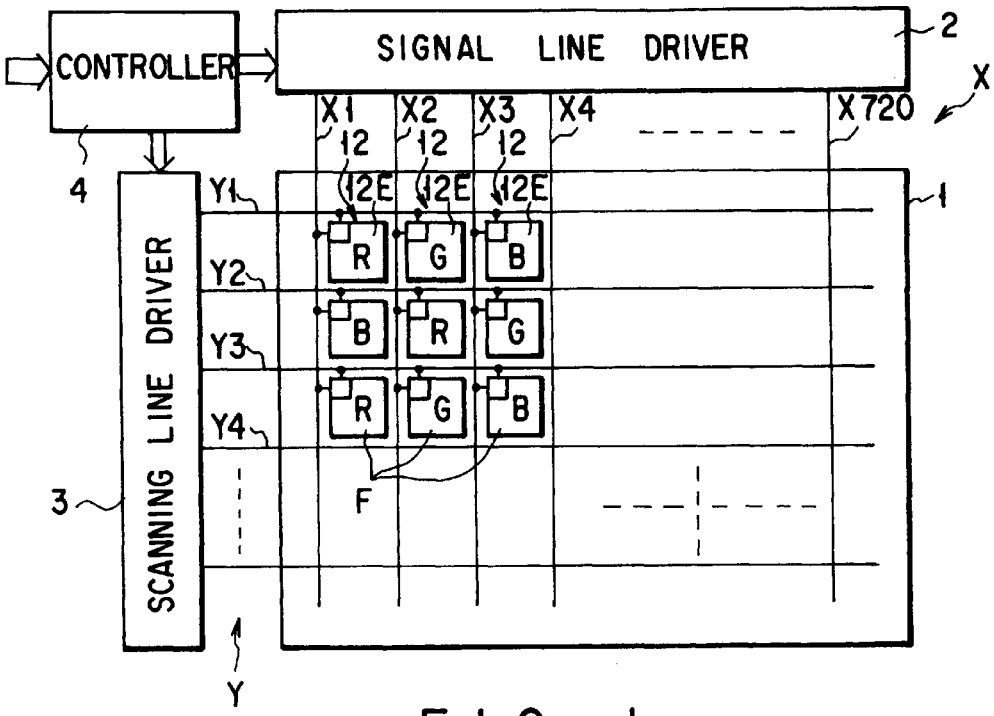
FIG. 1 is a circuit diagram showing the construction of a liquid crystal display device according to a first embodiment of this invention.

FIG. 1 shows the construction of the liquid crystal display device. For example, the liquid crystal display device has a liquid crystal panel 1 of delta array for displaying television broadcasting images in a colored form. The liquid crystal panel 1 has a matrix array of 230×720 pixels 12, 230 scanning lines Y1 to Y230 extending in a horizontal direction along the rows of the pixels 12, 720 signal lines X1 to X720 extending in a vertical direction along the columns of the pixels 12, and 230×720 color filters F for covering the pixels 12. The pixels 12 of each row have pixel electrodes 12E which are charged by signal voltages applied to the respective signal lines X1 to X720 while the pixels are being selected by a corresponding one scanning line Ym (m=1, 2, 3, - - - , 230). The distribution of the light transmittance of the liquid crystal in the screen is controlled by the potentials of the pixel electrodes 12E. The color filters F are constructed by red, green and blue filters R, G and B arranged in regular color order in the horizontal direction and selectively transmit lights of specified wave lengths.

The liquid crystal display device further includes a signal line driver 2 for driving the signal lines X1 to X720 of the liquid crystal panel 1, a scanning line driver 3 for driving the scanning lines Y1 to Y230 of the liquid crystal panel 1, and a liquid crystal controller 4 for controlling the signal line driver 2 and scanning line driver 3. The liquid crystal controller 4 extracts RGB color video signals VR, VG, and VB, a vertical synchronizing signal, and a horizontal synchronizing signal by demodulating a video signal of television broadcasting form, and outputs first and second control signals generated in synchronism with the vertical synchronizing signal and horizontal synchronizing signal together with the red video signal VR, green video signal VG and blue video signal VB. The scanning line driver 3 sequentially outputs a selection signal to the scanning lines Y1 to Y230 according to the first control signal, and the signal line driver 2 selectively outputs the red video signal VR, green video signal VG and blue video signal VB to the signal lines X1 to X720 according to the second control signal.

Figure 2:
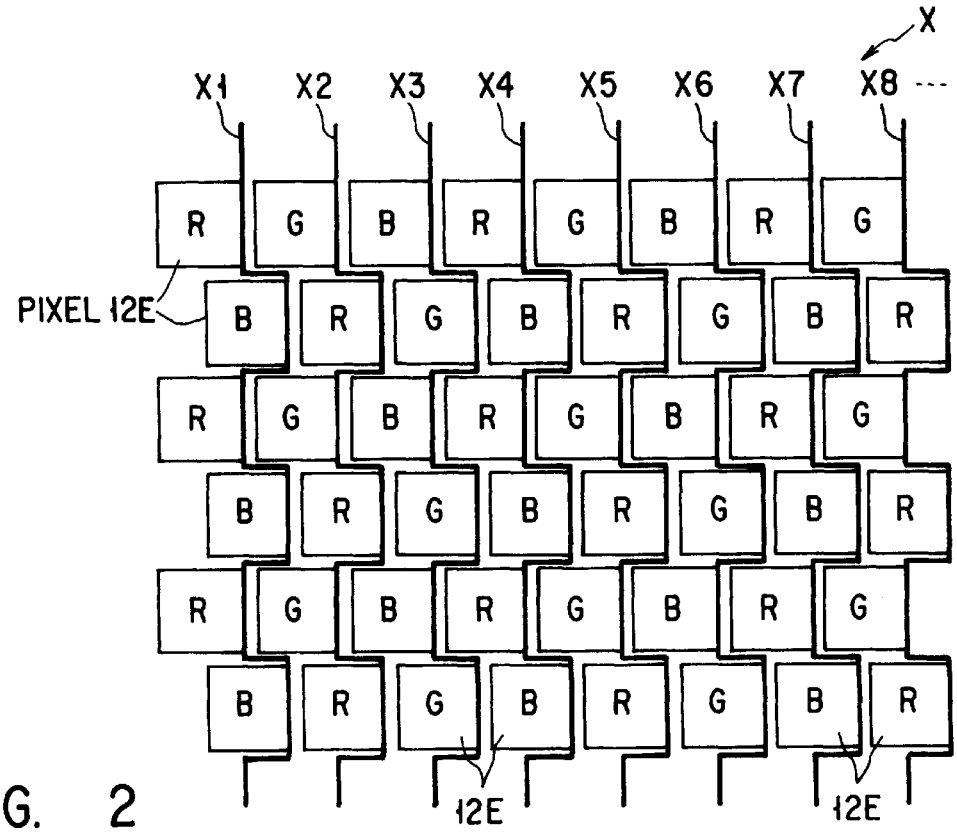
FIG. 2 is a plan view more precisely showing the arrangement between a plurality of pixels and color filters arranged on a liquid crystal panel shown in FIG. 1.

FIG. 2 shows the arrangement between the pixels 12 and the color filters F. The pixels 12 of the even rows are displaced back by 0.5 pixel in the horizontal direction with respect to the pixels 12 in the odd rows. The red filter R, green filter G and blue filter B are formed to cover the pixels 12 and arranged as shown in FIG. 2. Each signal line Xn (n=1, 2, 3, - - - , 720) is commonly connected to 230 pixels 12 arranged on a corresponding one of the columns. For example, the pixels 12 on the first column are covered with the red filters R and blue filters B which are alternately arranged in the vertical direction, the pixels 12 on the second column are covered with the green filters G and red filters R which are alternately arranged in the vertical direction, and the pixels 12 on the third column are covered with the blue filters B and green filters G which are alternately arranged in the vertical direction. The above-described array of the filters R, G and B is repeated for the pixels 12 on the fourth and succeeding columns. In the horizontal direction, the filters R, G, B are repeatedly arranged in the color order of RGBRGB - - - to cover the pixels 12 in the odd columns and repeatedly arranged in the color order of BRGBRG - - - to cover the pixels 12 on the even columns.

Since the pixels 12 and the color filters F are arranged with the above positional relation, the signal line driver 2 samples and holds different color video signals for the respective rows of the pixels 12 and outputs them to the signal lines X. The sampling timings of the color video signals are adjusted according to the positional deviation of 1/2 pixel between the pixels 12 of the odd row and the pixels 12 of the even row.

Figure 3:
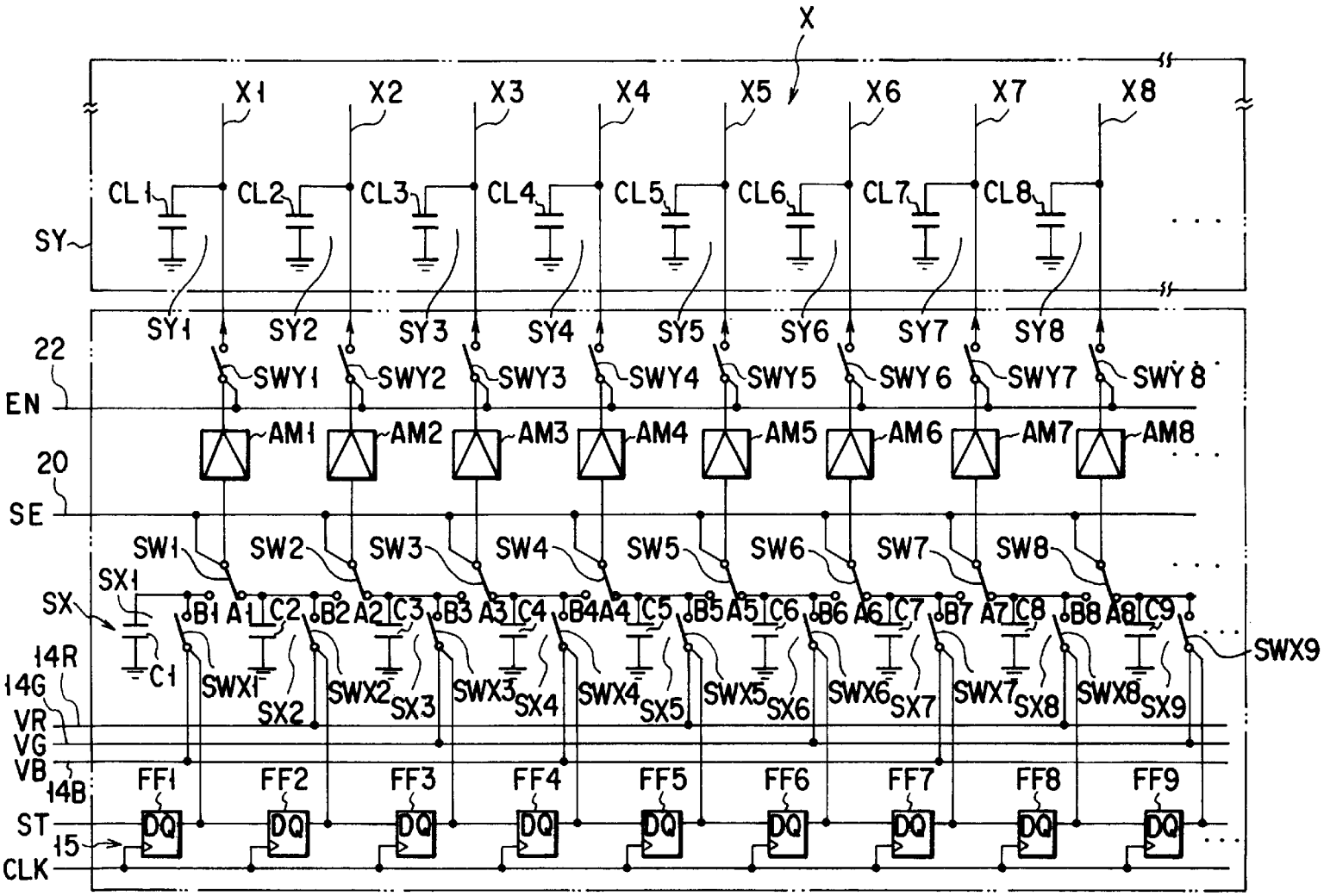
FIG. 3 is a circuit diagram showing the construction of a signal line driver shown in FIG. 1.

FIG. 3 shows the construction of the signal line driver 2. The signal line driver 2 includes bus lines 14R, 14G, 14B for transmitting a red video signal VR, green video signal VG, blue video signal VB supplied from the liquid crystal controller 4, a sample-hold section SX constructed by 721 sample-hold circuits SX1 to SX721 of a number larger than the number of signal lines by one, and a shift register 15 for sequentially enabling the sample-hold circuits SX1 to SX721. The bus lines 14B, 14R, 14G are respectively connected to the sample-hold circuits SX1 to SX721 in this order. The shift register 15 is constructed by 721 D-type flip-flops FF1 to FF721 which are connected to the liquid crystal controller 4 to receive a clock CLK and a start pulse ST supplied as a second control signal, and are cascade-connected to perform an operation of shifting the start pulse ST under the control of the clock CLK CL. The start pulse ST is supplied to the flip-flop FF1 for each horizontal scanning period set by the horizontal scanning signal and the clock CLK is commonly supplied to all of the flip-flops FF1 to FF721 in such a cycle as to permit the shifting operation of the shift register 15 to be repeatedly performed at least 721 times in one horizontal scanning period. Each of the flip-flops FF1 to FF721 latches the start pulse ST supplied to the D-input terminal thereof in response to the rise of the clock CLK and outputs the latched start pulse ST from the Q-output terminal thereof. Each of the sample-hold circuits SX1 to SX721 is connected to the Q-output terminal of a corresponding one of the flip-flops FF1 to FF721 to receive the start pulse ST as an enable signal and samples and holds a corresponding one of the red video signal VR, green video signal VG, blue video signal VB in response to the enable signal. The sample-hold circuits SX1 to SX721 respectively include switches SWX1 to SWX721 which are closed in a sampling period during which the enable signal is supplied and capacitors C1 to C721 for holding voltages of the color video signals supplied via the switches SWX1 to SWX721.

The sample-hold circuits SX1 to SX721 are connected to the bus lines 14B, 14R, 14G in the following manner to sequentially sample and hold corresponding ones of the color video signals VR, VG, VB in each horizontal scanning period.

The switches SWX1, SWX4, SWX7, - - - of the (3n-2)th (n=1, 2, 3, - - - ) sample-hold circuits SX1, SX4, SX7, - - - are commonly connected to the video signal bus 14B so that the color video signal VB can be sampled in response to the enable signals from the (3n-2)th flip-flops FF1, FF4, FF7, - - - and the sampling voltages can be held in the capacitors C1, C4, C7, - - - .

The switches SWX2, SWX5, SWX8, - - - of the (3n-1)th sample-hold circuits SX2, SX5, SX8, - - - are commonly connected to the bus line 14R so that the color video signal VR can be sampled in response to the enable signals from the flip-flops FF2, FF5, FF8, - - - and the sampling voltages can be held in the capacitors C2, C5, C8, - - - .

The switches SWX3, SWX6, SWX9, - - - of the (3n)th sample-hold circuits SX3, SX6, SX9, - - - are commonly connected to the bus line 14G so that the color video signal VG can be sampled in response to the enable signals from the (3n)th flip-flops FF3, FF6, FF9, - - - and the sampling signal voltages can be held in the capacitors C3, C6, C9, - - - .

Therefore, the color video signals VB, VR, VG are repeatedly sampled via the switches SWX1 to SWX721 which are sequentially selected according to the operation of shifting the start pulse ST and then held in the capacitors C1 to C721 corresponding to the switches SWX1 to SWX721.

The signal line driver 2 further includes selection switches SW1 to SW720 for selecting one of a first group of the sample-hold circuits SX2 to SX721 and a second group of the sample-hold circuits SX1 to SX720, amplifiers AM1 to AM720 respectively connected to the selection switches SW1 to SW720, and output switches SWY1 to SWY720 for electrically connecting the amplifiers AM1 to AM720 to the signal lines X1 to X720. The selection switches SW1 to SW720 have first switching terminals A1 to A720 respectively connected to the sample-hold circuits SX2 to SX721 of the first group and second switching terminals B1 to B720 respectively connected to the sample-hold circuits SX1 to SX720 of the second group and perform the selecting operation under the control of a selection signal SE supplied to a control line 20 as a second control signal from the liquid crystal controller 4. For example, when the selection signal SE is set at a logic level "0", the selection switches SW1 to SW720 select the sample-hold circuits SX2 to SX721 of the first group which are connected to the first switching terminals A1 to A720 so as to permit color video signals sampled and held by them to be output. On the other hand, when the selection signal SE is set at a logic level "1", the selection switches SW1 to SW720 select the sample-hold circuits SX1 to SX720 of the second group which are connected to the second switching terminals B1 to B720 so as to permit color video signals sampled and held by them to be output. The selection signal SE is set at the logic level "0" in a horizontal scanning period of selecting the pixels 12 in the odd row, and it is set to the logic level "1" in a horizontal scanning period of selecting the pixels 12 in the even row. The sample-hold circuits SX1 and SX721 do not operate in the same load condition as the sample-hold circuits SX2 to SX720 since each of them does not need to be connected to two selection switches. To make the load condition equal, it is preferable to connect dummy capacitors to the sample-hold circuits SX1 and SX721.

The amplifiers AM1 to AM720 generate output voltages corresponding to color video signal voltages from the sample-hold circuits of the selected group to drive the signal lines X1 to X720 via the output switches SWY1 to SWY720. That is, the amplifiers AM1 to AM720 are voltage followers for preventing the signal lines X1 to X720 from directly serving as loads of the sample-hold circuits of the selected group. The output switches SWY1 to SWY720 receive an output enable signal EN supplied to a control line 22 as a second control signal from the liquid crystal controller 4 after all of the amplifiers AM1 to AM720 have generated output voltages corresponding to the color video signal voltages from the sample-hold circuits of the selected group and electrically connect the amplifiers AM1 to AM720 to the signal lines X1 to X720, respectively, when the output enable signal EN is set at the logic level "1". The output switches SWY1 to SWY720 construct sample-hold circuits SY1 to SY720 in association with stray capacitances CL1 to CL720 of the signal lines X1 to X720. Therefore, output voltages of the amplifiers AM1 to AM720 are sampled in a sampling period during which the output switches SWY1 to SWY720 are simultaneously turned ON and held by the stray capacitances CL1 to CL720. In the signal line driver 2 with the above construction, the potentials of the signal lines X1 to X720 are set to match with the horizontal array of the color filters which respectively cover the pixels 12 of one row selected in each horizontal scanning period.

Next, the operation of the signal line driver 2 is explained with reference to FIG. 4.

Figure 4:
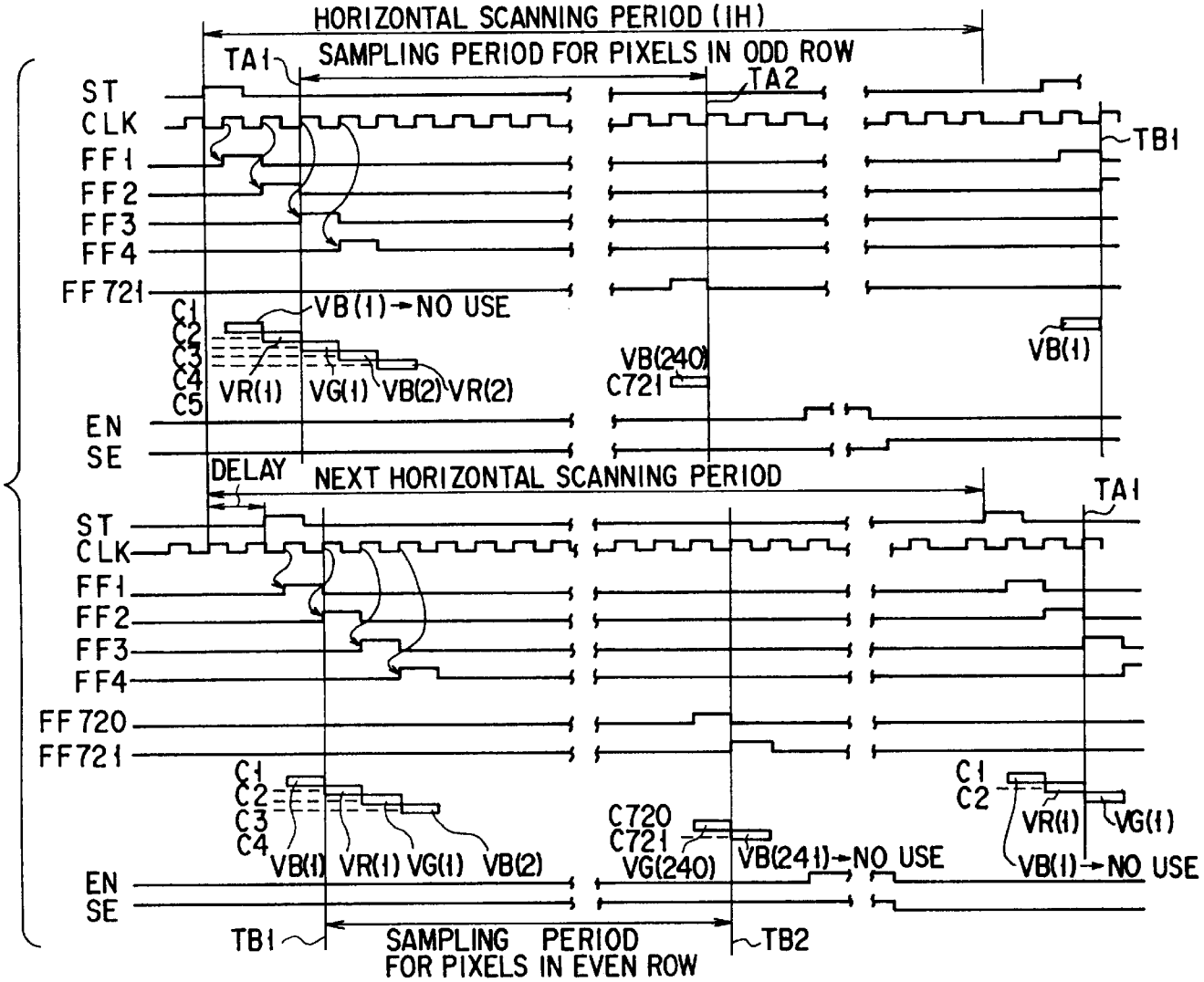
FIG. 4 is a time chart for illustrating the operation of the signal line driver shown in FIG. 3.

In an odd-numbered horizontal scanning period, the selection signal SE and output enable signal EN are initially at the logic level "0" as shown in FIG. 4. The selection switches SW1 to SW720 select the samplehold circuits SX2 to SX721 of the first group under the control of the selection signal SE. At this time, the output switches SWY1 to SWY720 set the signal lines X1 to X720 into electrically isolated states from the amplifiers AM1 to AM720.

In this state, the start pulse ST is supplied to the shift register 15. The start pulse ST is a signal which is kept at the logic level "1" for a preset period of time. The shift register 15 performs an operation of shifting the start pulse ST in synchronism with the clock CLK. In the shifting operation, the start pulse ST is sequentially stored in the flip-flops FF1 to FF721 and supplied therefrom to the sample-hold circuits SX2 to SX721 of the first group as enable signals. The sample-hold circuits SX2 to SX721 sequentially perform the sample-hold operations in response to the enable signals from the flip-flops FF1 to FF721. Thus, the color video signals VB, VR, VG are repeatedly sampled in this color order. The capacitors C1 to C721 of the sample-hold circuits SX1 to SX721 are charged by the sampling voltages of the color video signals VB, VR, VG. During this time, the input stray capacitances of the amplifiers AM1 to AM720 are also charged by the sampling voltages supplied from the sample-hold circuits SX2 to SX721 of the first group via the selection switches SW1 to SW720. The operation of the sample-hold circuit SX2 is completed at time TA1 and the operation of the sample-hold circuit SX721 is completed at time TA2. The amplifiers AM1 to AM720 continuously generate output voltages corresponding to the sampling voltages obtained from the sample-hold circuits SX2 to SX721.

The output enable signal EN is set to the logic level "1" after the elapse of the sampling period from the time TA1 to the time TA2. At this time, all of the output switches SWY1 to SWY720 are set in the conductive state for a preset period of time so as to electrically connect the amplifiers AM1 to AM720 to the signal lines X1 to X720. As a result, output voltages of the amplifiers AM1 to AM720 are simultaneously supplied to the signal lines X1 to X720 to charge the stray capacitances CL1 to CL720 of the signal lines X1 to X720. The signal lines X1 to X720 are electrically isolated from the amplifiers AM1 to AM720 by means of the output switches SWY1 to SWY720 when the output enable signal EN is returned to the logic level "0". Then, the potentials of the signal lines X1 to X720 are maintained by the stray capacitances CL1 to CL720 for a period corresponding to one horizontal scanning period, after which the enable signal EN is set to the logic level "1" again.

Thus, the pixels 12 of the odd row are driven by the potentials of the signal lines X1 to X720 set for the color order of RGBRGB - - - .

In the odd-numbered horizontal scanning period, the selection switches SW1 to SW720 select the sample-hold circuits SX2 to SX721 of the first group and make invalid the sampling voltage of the color video signal VB held in the capacitor C1 of the sample-hold circuit SX1. Therefore, the effective sampling period is set to a period from the time TA1 at which the capacitor C2 of the sample-hold circuit SX2 holds the sampling voltage of the color video signal VR to the time TA2 at which the capacitor C721 of the sample-hold circuit SX721 holds the sampling voltage of the color video signal VG.

In an even-numbered horizontal scanning period, as shown in FIG. 4, the selection signal SE is previously set at the logic level "1" and the output enable signal EN is previously set at the logic level "0". The selection switches SW1 to Sw720 select the sample-hold circuits SX1 to SX720 of the second group by the control of the selection signal SE. The output switches SWY1 to SWY720 set the signal lines X1 to X720 into an electrically isolated state from the amplifiers AM1 to AM720.

In this state, the start pulse ST is supplied to the shift register 15 as in the case of the odd-numbered horizontal scanning period. The shift register 15 performs the shifting operation of the start pulse ST in synchronism with the clock CLK. The start pulse ST is sequentially stored in the flip-flops FF1 to FF721, and supplied to the sample-hold circuits SX2 to SX721 of the first group as enable signals. The sample-hold circuits SX2 to SX721 sequentially perform the sample-hold operations in response to the enable signals from the flip-flops FF1 to FF721. Thus, the color video signals VB, VR, VG are repeatedly sampled in this color order. The capacitors C1 to C721 of the sample-hold circuits SX1 to SX721 are charged by sampling voltages of the color video signals VB, VR, VG. During this time, the input stray capacitances of the amplifiers AM1 to AM720 are also charged by sampling voltages supplied from the sample-hold circuits SX1 to SX720 of the second group via the selection switches SW1 to SW720. The operation of the sample-hold circuit SX1 is completed at time TB1 and the operation of the sample-hold circuit SX720 is completed at time TB2. The amplifiers AM1 to AM720 continuously generate output voltages corresponding to the sampling voltages obtained from the sample-hold circuits SX2 to SX721.

The output enable signal EN is set to the logic level "1" after the elapse of the sampling period from the time TB1 to the time TB2. At this time, all of the output switches SWY1 to SWY720 are set in the conductive state for a preset period of time so as to electrically connect the amplifiers AM1 to AM720 to the signal lines X1 to X720. As a result, output voltages of the amplifiers AM1 to AM720 are simultaneously supplied to the signal lines X1 to X720 to charge the stray capacitances CL1 to CL720 of the signal lines X1 to X720. The signal lines X1 to X720 are electrically isolated from the amplifiers AM1 to AM720 by means of the output switches SWY1 to SWY720 when the output enable signal EN is returned to the logic level "0". Then, the potentials of the signal lines X1 to X720 are maintained by the stray capacitances CL1 to CL720 for a period corresponding to one horizontal scanning period, after which the enable signal EN is set to the logic level "1" again.

Thus, the pixels 12 of the even row are driven by the potentials of the signal lines X1 to X720 set for the color order of BRGBRG - - - .

In the even-numbered horizontal scanning period, the selection switches SW1 to SW720 select the sample-hold circuits SX1 to SX720 of the second group and make invalid the sampling voltage of the color video signal VG held in the capacitor C721 of the sample-hold circuit SX721. Therefore, the effective sampling period is set to a period from the time TB1 at which the capacitor C1 of the sample-hold circuit SX1 holds the sampling voltage of the color video signal VB to the time TB2 at which the capacitor C720 of the sample-hold circuit SX720 holds the sampling voltage of the color video signal VG.

Further, the sampling timings of the color video signals VR, VG, VB are adjusted to compensate for the positional deviation in the horizontal direction between the pixels 12 of the odd row and the pixels 12 of the even row. Specifically, the phase of the clock CLK is delayed by 0.5 pixel more at the time of scanning of the pixels 12 in the even row than at the time of scanning of the pixels 12 in the odd row. Further, the phase of the start pulse ST is delayed by 1.5 pixels at the time of scanning of the pixels 12 in the even row than at the time of scanning of the pixels 12 in the odd row so as to permit the sample-hold circuit SX1 which is not used in the scanning for the odd row to be used.

In the liquid crystal display device of the first embodiment, the sample-hold circuits SX1 to SX721 perform an operation of sequentially sampling and holding the color video signals VR, VG, VB directly supplied to the bus lines 14R, 14G, 14B, and the selection switches SW1 to SW721 select sampling voltages derived from the sample-hold circuits SX1 to SX721. That is, since the color video signals VR, VG, VB are supplied to the bus lines 14R, 14G, 14B without passing through a switching unit which is used in the prior art, it is possible to prevent a low-pass filter from being constructed by the stray capacitances of the bus lines 14R, 14G, 14B and the output impedance of the above switching unit. As a result, the high-speed operation can be attained without significantly increasing the power consumption.

Further, since the signal sources for the color video signals VR, VG, VB are not required to have driving abilities for driving the stray capacitances of the bus lines 14R, 14G, 14B along with the stray capacitance of the switching unit as loads, the power consumption of the signal source can be reduced.

Further, the selection switches SW1 to SW720 are arranged on the output sides of the sample-hold circuits SX1 to SX721 and constructed to perform the switching operation once for each horizontal scanning period. That is, since it is not necessary to frequently charge and discharge the stray capacitances of the selection switches SW1 to SW720, the power consumption of the selection switches SW1 to SW720 can be reduced.

Figure 5:
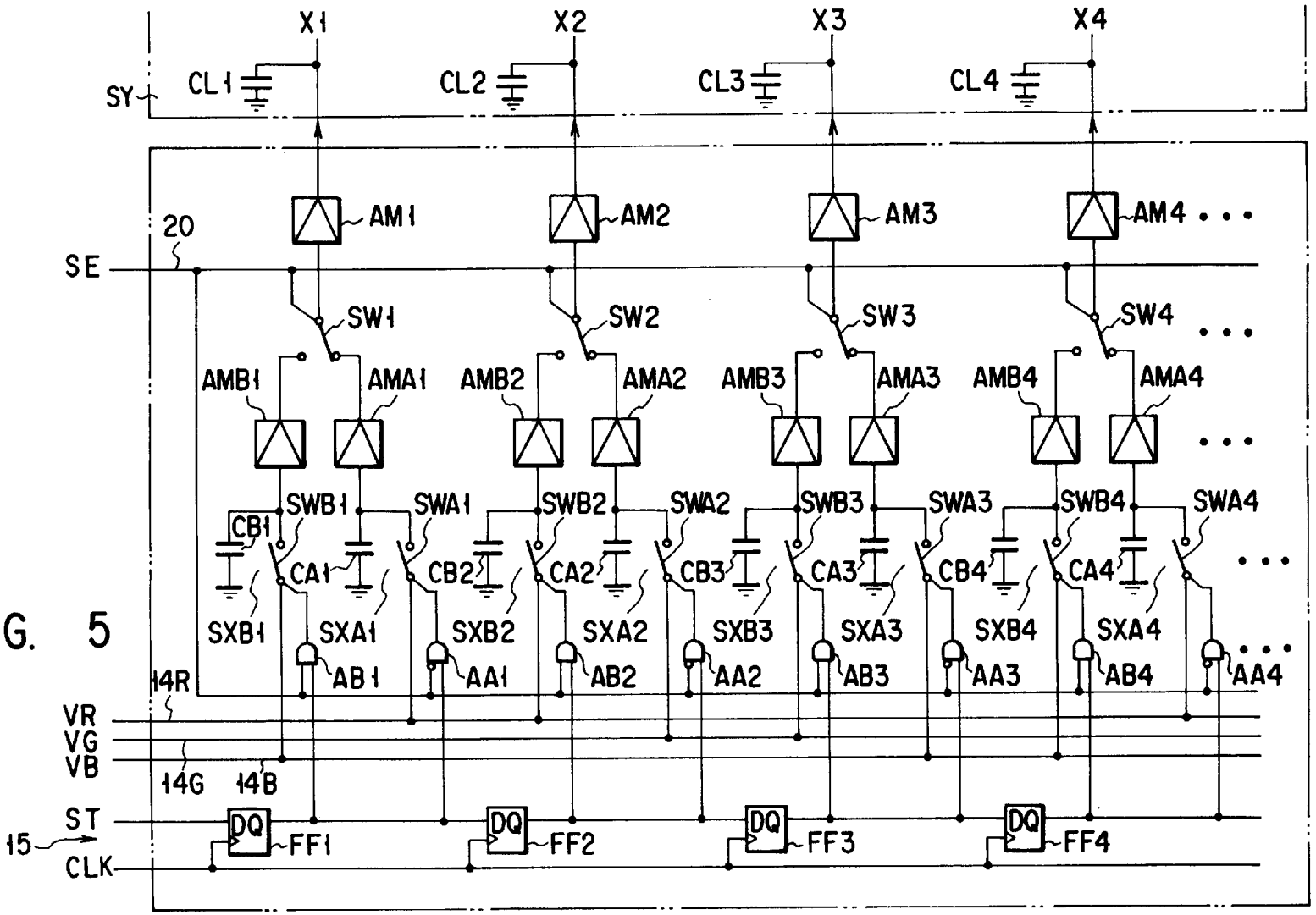
FIG. 5 is a circuit diagram showing the construction of a signal line driver of a liquid crystal display device according to a second embodiment of this invention.

Next, a liquid crystal display device according to a second embodiment of this invention is explained with reference to FIG. 5. The liquid crystal display device is similar to that of the first embodiment except that a signal line driver 2 is constructed as shown in FIG. 5. Therefore, portions which are the same as those of the first embodiment are denoted by the same reference numerals and the repetitive explanation therefor is omitted.

As shown in FIG. 5, the signal line driver 2 in the second embodiment includes bus lines 14R, 14G, 14B for transmitting a red video signal VR, green video signal VG, and blue video signal VB supplied from a liquid crystal controller 4, a sample-hold section SX constructed by 720 first sample-hold circuits SXA1 to SXA720, 720 second sample-hold circuits SXB1 to SXB720, and a shift register 15 for sequentially enabling the sample-hold circuits SXA1 to SXA720 and SXB1 to SXB720. The bus lines 14R, 14G, 14B are respectively connected to the first sample-hold circuits SXA1 to SXA720 in the color order of RGBRGB - - - and respectively connected to the second sample-hold circuits SXB1 to SXB720 in the color order of BRGBRG - - - . The shift register 15 is constructed by 720 D-type flip-flops FF1 to FF720 which are connected to the liquid crystal controller 4 to receive a clock CLK and a start pulse ST supplied as a second control signal, and the flip-flops are cascade-connected to perform an operation of shifting the start pulse ST under the control of the clock CLK. The start pulse ST is supplied to the flip-flop FF1 for each horizontal scanning period set by the horizontal scanning signal, and the clock CLK is commonly supplied to all of the flip-flops FF1 to FF720 in such a cycle as to permit the shifting operation of the shift register 15 to be repeatedly performed at least 720 times in the horizontal scanning period. Each of the flip-flops FF1 to FF721 latches the start pulse ST supplied to the D-input terminal thereof in response to the rise of the clock CLK and outputs the latched start pulse ST from the Q-output terminal thereof. Each of the sample-hold circuits SXA1 to SXA720 and SXB1 to SXB720 is connected to the Q-output terminal of a corresponding one of the flip-flops FF1 to FF720 to receive the start pulse ST as an enable signal and samples and holds a corresponding one of the red video signal VR, green video signal VG, blue video signal VB in response to the enable signal. The first sample-hold circuits SXA1 to SXA720 are respectively constructed by AND gates AA1 to AA720, switches SWA1 to SWA720 which are closed in a sampling period in which the enable signal is supplied to the AND gates AA1 to AA720, capacitors CA1 to CA720 for holding voltages of the color video signals supplied via the switches SWA1 to SWA720, and amplifiers AMA1 to AMA720 for receiving the voltages held in the capacitors CA1 to CA720. The second sample-hold circuits SXB1 to SXB720 are respectively constructed by AND gates AB1 to AB720, switches SWB1 to SWB720 which are closed in a sampling period in which the enable signal is supplied to the AND gates AB1 to AB720, capacitors CB1 to CB720 for holding voltages of the color video signals supplied via the switches SWB1 to SWB720, and amplifiers AMB1 to AMB720 for receiving the voltages held in the capacitors CB1 to CB720. The AND gates AA1 to AA720 have first input terminals for respectively receiving the enable signals from the flip-flops FF1 to FF720 and second input terminals for commonly receiving an inverted signal of the selection signal SE supplied from the control line 20 via an inverter, and respectively supply the enable signals from the flip-flops FF1 to FF720 to the switches SWA1 to SWA720 when the selection signal SE is set at the logic level "0". The AND gates AB1 to AB720 have first input terminals for respectively receiving the enable signals from the flip-flops FF1 to FF720 and second input terminals for commonly receiving the selection signal SE supplied from the control line 20, and respectively supply the enable signals from the flip-flops FF1 to FF720 to the switches SWB1 to SWB720 when the selection signal SE is set at the logic level "1".

The first sample-hold circuits SXA1 to SXA720 and the second sample-hold circuits SXB1 to SXB720 are connected to the bus lines 14B, 14R, 14G in the following manner to sequentially sample and hold corresponding ones of the color video signals VR, VG, VB in each horizontal scanning period.

The switches SWA1, SWA4, SWA7, - - - of the (3n-2)th (n=1, 2, 3, - - - ) first sample-hold circuits SXA1, SXA4, SXA7, - - - are commonly connected to the video signal bus 14R so that the color video signal VR can be sampled in response to the enable signals from the (3n-2)th flip-flops FF1, FF4, FF7, - - - and the sampling voltages can be held in the capacitors CA1, CA4, CA7, - - - . The switches SWB1, SWB4, SWB7, - - - of the (3n-2)th second sample-hold circuits SXB1, SXB4, SXB7, - - - are commonly connected to the video signal bus 14B so that the color video signal VB can be sampled in response to the enable signals from the (3n-2)th flip-flops FF1, FF4, FF7, - - - and the sampling voltages can be held in the capacitors CB1, CB4, CB7, - - - .

The switches SWA2, SWA5, SWA8, - - - of the (3n-1)th first sample-hold circuits SXA2, SXA5, SXA8, - - - are commonly connected to the bus line 14G so that the color video signal VG can be sampled in response to the enable signals from the flip-flops FF2, FF5, FF8, - - - and the sampling voltages can be held in the capacitors C2, C5, C8, - - - . The switches SWB2, SWB5, SWB8, - - - of the (3n-1)th second sample-hold circuits SXB2, SXB5, SXB8, - - - are commonly connected to the bus line 14R so that the color video signal VR can be sampled in response to the enable signals from the flip-flops FF2, FF5, FF8, - - - and the sampling voltages can be held in the capacitors C2, C5, C8, - - - .

The switches SWA3, SWA6, SWA9, - - - of the (3n)th first sample-hold circuits SXA3, SXA6, SXA9, - - - are commonly connected to the bus line 14B so that the color video signal VB can be sampled in response to the enable signals from the (3n)th flip-flops FF3, FF6, FF9, - - - and the sampling signal voltages can be held in the capacitors C3, C6, C9, - - - . The switches SWB3, SWB6, SWB9, - - - of the (3n)th second sample-hold circuits SXB3, SXB6, SXB9, - - - are commonly connected to the bus line 14G so that the color video signal VG can be sampled in response to the enable signals from the (3n)th flip-flops FF3, FF6, FF9, - - - and the sampling signal voltages can be held in the capacitors C3, C6, C9, - - - .

Therefore, when the selection signal SE is set at the logic level "0", the color video signals VR, VG, VB are repeatedly sampled via the switches SWA1 to SWA720 which are sequentially selected according to the shifting operation of the start pulse ST and then held in the capacitors CA1 to CA720 corresponding to the switches SWA1 to SWA720. Further, when the selection signal SE is set at the logic level "1", the color video signals VB, VR, VG are repeatedly sampled via the switches SWB1 to SWB720 which are sequentially selected according to the shifting operation of the start pulse ST and then held in the capacitors CB1 to CB720 corresponding to the switches SWB1 to SWB720.

Like the first embodiment, the signal line driver 2 includes selection switches SW1 to SW720, and amplifiers AM1 to AM720. The selection switches SW1 to SW720 are used for selecting the first sample-hold circuits SXA1 to SXA720 or the second sample-hold circuits SXB1 to SXB720. The selection switches SW1 to SW720 have first switching terminals respectively connected to the first sample-hold circuits SXA1 to SXA720 and second switching terminals respectively connected to the second sample-hold circuits SXB1 to SXB720 and perform the selecting operation under the control of the selection signal SE supplied to the control line 20 as a second control signal from the liquid crystal controller 4. For example, when the selection signal SE is set at the logic level "0", the selection switches SW1 to SW720 select the second sample-hold circuits SXB1 to SXB720 connected to the second switching terminals thereof so as to permit color video signals sampled and held by them to be output. On the other hand, when the selection signal SE is set at the logic level "1", the selection switches SW1 to SW720 select the first sample-hold circuits SXA1 to SXA720 connected to the first switching terminals thereof so as to permit color video signals sampled and held by them to be output. The selection signal SE is set at the logic level "1" in a horizontal scanning period of selecting the pixels 12 in the odd row and set to the logic level "0" in a horizontal scanning period of selecting the pixels 12 in the even row.

The amplifiers AM1 to AM720 generate output voltages corresponding to color video signal voltages from the selected sample-hold circuits to directly drive the signal lines X1 to X720. The output voltages of the amplifiers AM1 to AM720 are sequentially held by the stray capacitances CL1 to CL720 of the signal lines X1 to X720. In the signal line driver with the above construction, the potentials of the signal lines X1 to X720 are set to match with the horizontal array of the color filters which respectively cover the pixels 12 of one row selected in each horizontal scanning period.

Next, the operation of the signal line driver 2 is explained with reference to FIG. 6.

Figure 6:
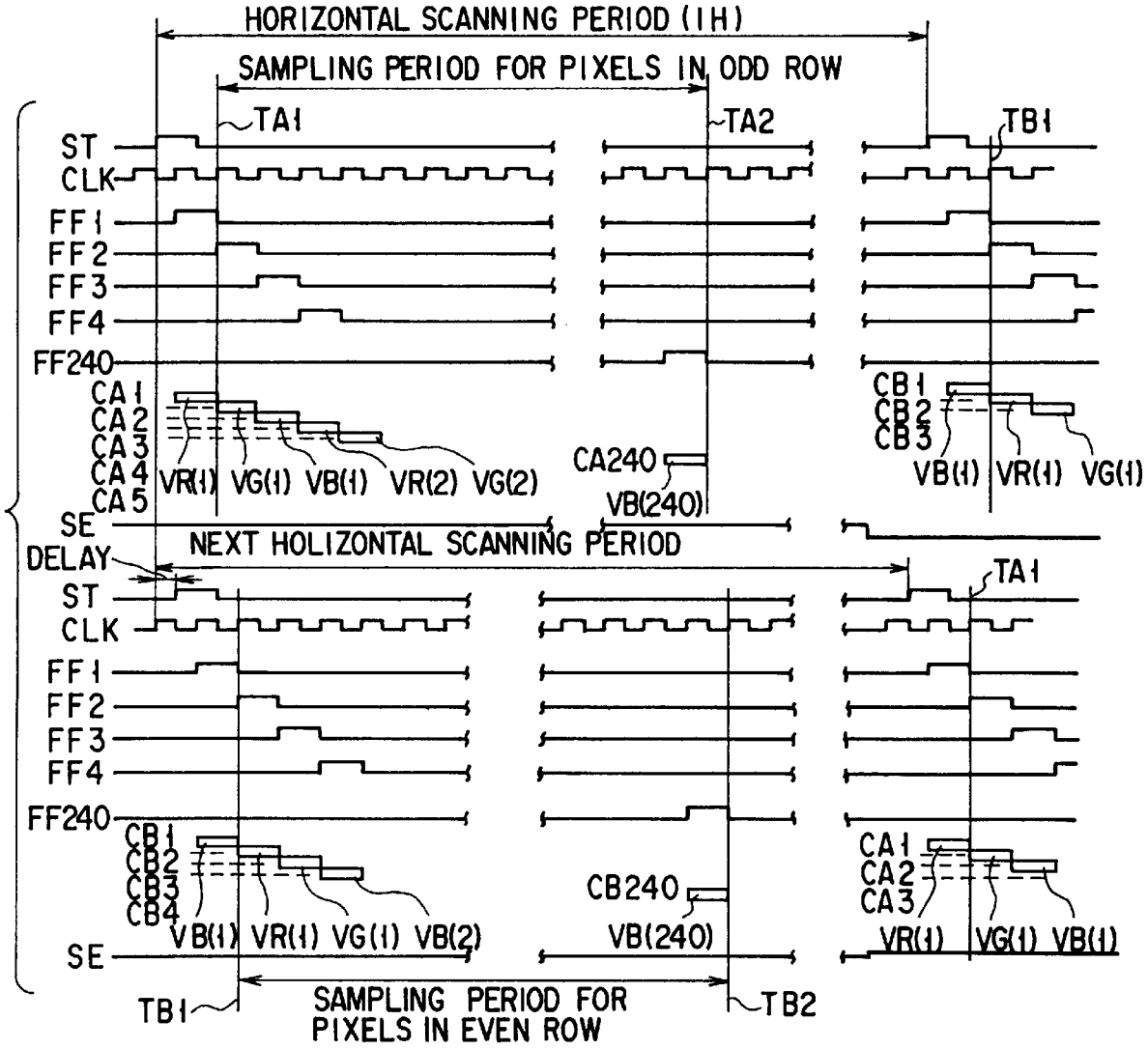
FIG. 6 is a time chart for illustrating the operation of the signal line driver shown in FIG. 5.

In an even-numbered horizontal scanning period, the selection signal SE is initially at the logic level "0" as shown in FIG. 6. The selection switches SW1 to SW720 select the second sample-hold circuits SXB1 to SXB720 under the control of the selection signal SE. At this time, the AND gates AA1 to AA720 are enabled to output enable signals and the AND gates AB1 to AB720 are disabled and inhibited from outputting enable signals.

In this state, the start pulse ST is supplied to the shift register 15. The start pulse ST is a signal which is kept at the logic level "1" for a preset period of time. The shift register 15 performs the operation of shifting the start pulse ST in synchronism with the clock CLK. In the shifting operation, the start pulse ST is sequentially stored in the flip-flops FF1 to FF721 sequentially and supplied to the AND gates AA1 to AA720 and AB1 to AB720 as enable signals. The enable signals are sequentially supplied only to the first sample-hold circuits SXA1 to SXA720 via the AND gates AA1 to AA720. The first sample-hold circuits SXA1 to SXA720 sequentially perform sample-hold operations in response to the enable signals from the flip-flops FF1 to FF720. Thus, the color video signals VR, VG, VB are repeatedly sampled in this color order. The capacitors CA1 to CA720 of the first sample-hold circuits SXA1 to SXA720 are charged by the sampling voltages of the color video signals VR, VG, VB. During this time, the input stray capacitances of the amplifiers AMA1 to AMA720 are also charged by the sampling voltages. The amplifiers AMA1 to AMA720 generate output voltages corresponding to the sampling voltages. These output voltages are used to charge the input stray capacitances of the amplifiers AM1 to AM720 via the selection switches SW1 to SW720 in the next horizontal scanning period of selecting the pixels 12 in the odd row. The operation of the sample-hold circuit SXA1 is completed at time TA1 and the operation of the sample-hold circuit SXA720 is completed at time TA2. The amplifiers AM1 to AM720 continuously generate output voltages corresponding to the output voltages obtained from the amplifiers AMB1 to AMB720 of the sample-hold circuits SXB1 to SXB720 in the previous horizontal scanning period. The output voltages of the amplifiers AM1 to AM720 are supplied to the signal lines X1 to X720 to charge the stray capacitances CL1 to CL720 of the signal lines X1 to X720. The potentials of the signal lines X1 to X720 are maintained by the stray capacitances CL1 to CL720 for a period corresponding to one horizontal scanning period, after which output voltages of the amplifiers AM1 to AM720 are changed again.

Thus, the pixels 12 of the odd row are driven by the potentials of the signal lines X1 to X720 set for the color order of RGBRGB - - - .

In a odd-numbered horizontal scanning period, as shown in FIG. 6, the selection signal SE is initially at the logic level "1". The selection switches SW1 to SW720 select the first sample-hold circuits SXA1 to SXA720 by the control of the selection signal SE. At this time, the AND gates AA1 to AA720 are disabled and inhibited from outputting enable signals and the AND gates AB1 to AB720 are enabled to output enable signals.

In this state, like the case of the even-numbered horizontal scanning period, the start pulse ST is supplied to the shift register 15. The shift register 15 performs an operation of shifting the start pulse ST in synchronism with the clock CLK. In the shifting operation, the start pulse ST is sequentially stored in the flip-flops FF1 to FF721 and supplied to the AND gates AA1 to AA720 and AB1 to AB720 as enable signals. The enable signals are sequentially supplied only to the second sample-hold circuits SXB1 to SXB720 via the AND gates AB1 to AB720. The second sample-hold circuits SXB1 to SXB720 sequentially perform the sample-hold operations in response to the enable signals from the flip-flops FF1 to FF720. Thus, the color video signals VB, VR, VG are repeatedly sampled in this color order. The capacitors CB1 to CB720 of the second sample-hold circuits SXB1 to SXB720 are charged by the sampling voltages of the color video signals VB, VR, VG. During this time, the input stray capacitances of the amplifiers AMB1 to AMB720 are also charged by the sampling voltages. The amplifiers AMB1 to AMB720 generate output voltages corresponding to the sampling voltages. These output voltages are used to charge the input stray capacitances of the amplifiers AM1 to AM720 via the selection switches SW1 to SW720 in the next horizontal scanning period of selecting the pixels 12 in the even row. The operation of the sample-hold circuit SXB1 is completed at time TB1 and the operation of the sample-hold circuit SXB720 is completed at time TB2. The amplifiers AM1 to AM720 continuously generate output voltages corresponding to the output voltages obtained from the amplifiers AMA1 to AMA720 of the sample-hold circuits SXA1 to SXA720 in the previous horizontal scanning period. The output voltages of the amplifiers AM1 to AM720 are supplied to the signal lines X1 to X720 to charge the stray capacitances CL1 to CL720 of the signal lines X1 to X720. The potentials of the signal lines X1 to X720 are maintained by the stray capacitances CL1 to CL720 for a period corresponding to one horizontal scanning period, after which the output voltages of the amplifiers AM1 to AM720 are changed again.

Thus, the pixels 12 of the odd row are driven by the potentials of the signal lines X1 to X720 set for the color order of BRGBRG - - - .

Further, the sampling timings of the color video signals VR, VG, VB are adjusted to compensate for the positional deviation in the horizontal direction between the pixels 12 of the odd row and the pixels 12 of the even row. Specifically, the phase of the clock CLK is delayed by 0.5 pixel more at the time of scanning of the pixels 12 in the odd row than at the time of scanning of the pixels 12 in the even row. Likewise, the phase of the start pulse ST is delayed by 0.5 pixel more at the time of scanning of the pixels 12 in the odd row than at the time of scanning of the pixels 12 in the even row.

In the liquid crystal display device of embodimend embodiment, the same effect as that of the first embodiment can be attained. Further, the selecting switches SW1 to SW720 are constructed to supply to the signal lines X1 to X720 output voltages obtained as a result of sampling performed in the previous horizontal scanning period. Therefore, the liquid display device does not need to have the output switches SWY1 to SWY720 which are connected between the amplifiers AM1 to AM720 and the signal lines X1 to X720 in the first embodiment, and can start charging of the stray capacitances CL1 to CL720 upon switching of the selecting switches SW1 to SW720. Since the stray capacitances CL1 to CL720 may be charged by the amplifiers AM1 to AM720 throughout one horizontal scanning period, it is possible to prevent the power consumption from being excessively increased due to the charging operation.

Figure 7:
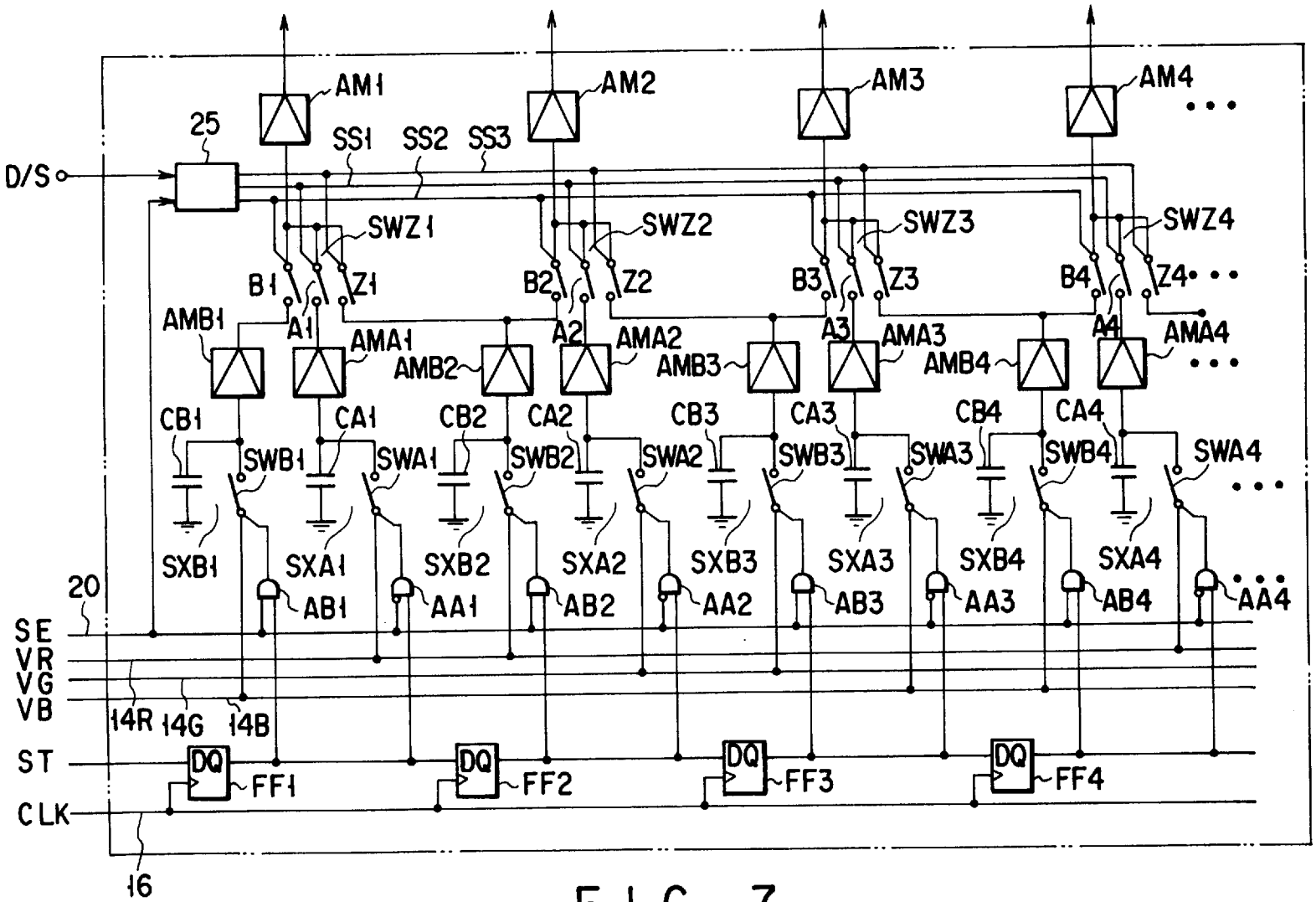
FIG. 7 is a circuit diagram showing a modification of the signal line driver shown in FIG. 5.

A modification of the signal line driver 2 shown in FIG. 5 is shown in FIG. 7.

The signal line driver of the modification is so constructed as to be applied not only to a liquid crystal panel 1 having red, blue and green filters arranged in a delta form but also to a liquid crystal panel having red, blue and green filters arranged in a stripe form to cover pixels 12 arranged in lines. That is, in this modification, the selection switches SW1 to SW720 shown in FIG. 5 are replaced by selection switches SWZ1 to SWZ720 and a control section 25 for controlling the selection switches SWZ1 to SWZ720. Further, a flip-flop FF721 is connected to the output stage of a flip-flop FF720 and a sample-hold circuit SXB721 is connected to be controlled by the flip-flop FF721. The sample-hold circuit SXB721 is formed with the same construction as the sample-hold circuit SXB1. The control section 25 is connected to receive a mode signal D/S and selection signal SE and generates one of switch signals SS1, SS2, SS3 according to the mode signal D/S and selection signal SE. The mode signal D/S is determined based on the delta or stripe array of the color filters, and can be obtained by connecting the input terminal to one of a power source terminal which is set at the logic level "D" and a power source terminal which is set at the logic level "S". The switch signals SS1 and SS2 are selectively generated based on the level of the selection signal SE when the mode signal D/S indicates the delta array mode and the switch signal SS3 is generated irrespective of the level of the selection signal SE when the mode signal D/S indicates the stripe array mode. The selection switches SWZ1 to SWZ720 have first switching terminals A1 to A720 to be connected to the output terminals of amplifiers AMA1 to AMA720 of the sample-hold circuits SXA1 to SXA720, second switching terminals B1 to B720 to be connected to the output terminals of amplifiers AMB1 to AMB720 of the sample-hold circuits SXB1 to SXB720, and third switching terminals Z1 to Z720 to be connected to the output terminals of amplifiers AMB2 to AMB721 of the sample-hold circuits SXB2 to SXB721. When the switch signal SS1 is supplied to the selection switches SWZ1 to SWZ720, the selection switches SWZ1 to SWZ720 electrically connect the amplifiers AM1 to AM720 to the sample-hold circuits SXA1 to SXA720, respectively. When the switch signal SS2 is supplied to the selection switches SWZ1 to SWZ720, the selection switches SWZ1 to SWZ720 electrically connect the amplifiers AM1 to AM720 to the sample-hold circuits SXB2 to SXB720, respectively. Further, when the switch signal SS3 is supplied to the selection switches SWZ1 to SWZ720, the selection switches SWZ1 to SWZ720 electrically connect the amplifiers AM1 to AM720 to the sample-hold circuits SXB2 to SXB721, respectively.

Like the signal line driver 2 shown in FIG. 5, in the delta array mode, the signal line driver of this modification allocates the output voltages of the first sample-hold circuits SXA1 to SXA720 or the output voltages of the second sample-hold circuits SXB1 to SXB720 to the respective signal lines X1 to X720 for each horizontal scanning period and allocates the output voltages of the sample-hold circuits SXB2 to SXB721 to the respective signal lines X1 to X720 for each horizontal scanning period in the stripe array mode. That is, in the stripe array mode, the signal lines X1 to X720 are driven based on the sampling voltages of the same color video signals derived as the output voltages of the sample-hold circuits SXB2 to SXB721 irrespective of the selected row of the pixels 12.

In this case, since the sampling period in the stripe array mode is delayed by one clock required for operating the flip-flop FF1, the start pulse ST is supplied to the shift register 15 in the stripe array mode at the time earlier by one clock than in the delta array mode.

In the signal line driver of this modification, since the color filters of the liquid crystal panel can be used in each of the stripe array and delta array, the manufacturing cost can be lowered in comparison with a case wherein different types of signal line drivers are manufactured for different arrays of the color filters.

In a case where the array of pixels 12 are driven by voltages whose polarity is periodically changed, the pairs of bus lines 14R, 14G, 14B may be provided for the positive and negative poralities. However, this increases the number of bus lines. In this case, different color video signals may be combined into a composite video signal which is transferred by the same bus line. For example, a red and green video signal of a positive polality is transferred by one bus line, and a red and green video signal of a negative polarity is transferred by another bus line.

Additional advantages and modifications will be readily apparent to those skilled in the art. Therefore, the invention in its broader aspects is not limited to the specific details and representative embodiments shown and described herein. Various modifications may be made without departing from the spirit or scope of the general inventive concept as defined by the appended claims and their equivalents.

We claim:

1. A signal line driving circuit for a flat-panel display device including a matrix of pixels and a plurality of signal lines for setting potentials of the pixels of respective rows, said circuit comprising:

a plurality of bus lines for receiving a plurality of color video signals;

a plurality of sample-hold circuits each connected to a bus line, for sampling and holding the color video signals on the bus lines and producing respective output voltages;

selecting means for selecting for each signal line one of plural output voltages of sample-hold circuits connected to different bus lines; and control means for sequentially enabling said plurality of sample-hold circuits.

2. The signal line driving circuit according to claim 1, wherein said matrix of pixels comprises odd and even rows, pixels in said odd rows being arranged in a first color order and pixels in said even rows being arranged in a second color order different from the first color order.

3. The signal line driving circuit according to claim 2, wherein said control means comprises a shift register having a plurality of flip-flops cascade-connected along said bus lines, for shifting a start pulse at each clock cycle;

said plurality of sample-hold circuits sequentially sampling and holding color video signals on said plurality of bus lines under the control of said flip-flops; and said selecting means including a plurality of selection switches each connected to two of said sample-hold circuits, and each being operated under the control of an adjacent pair of said flip-flops, for alternatively selecting one of said two sample-hold circuits.

4. The signal line driving circuit according to claim 3, further comprising timing adjusting means for sequentially receiving output voltages of said sample-hold circuits selected by said selecting means and simultaneously outputting the received output voltages when all the selected sample-hold circuits are complete in their operation.

5. The signal line driving circuit according to claim 4, wherein said timing adjusting means comprises a plurality of output switches connecting said plurality of selection switches to respective ones of said plurality of signal lines and forming a plurality of sample-hold circuits in association with stray capacitances of said plurality of said signal lines.

6. The signal line driving circuit according to claim 2, wherein said control means comprises a shift register comprising a plurality of flip-flops cascade-connected along said bus lines, for shifting a start pulse at each clock cycle;

said plurality of sample-hold circuits comprises a plurality of first sample-hold circuits connected to said bus lines based upon a first color order and operated under the control of certain ones of said flip-flops, said plurality of sample-hold circuits further comprising a plurality of second sample-hold circuits connected to said bus lines based upon a second color order and operated under the control of certain others of said flip-flops; and said selecting means comprises a plurality of selection switches each connected to a sample-hold circuit pair comprising one of said first sample-hold circuits and one of said second sample-hold circuits, said sample-hold circuit pair being controlled by a corresponding one of said flip-flops, which alternatively selects one of said first and second sample-hold circuits of said pair.

7. The signal line driving circuit according to claim 6, wherein said selecting means comprises mode setting means for setting one of first and second modes, and a plurality of selection switches each connected to one of said sample-hold circuit pairs, each sample-hold circuit of each sample-hold circuit pair being controlled by a corresponding one of said flip-flops, a predetermined sample-hold circuit being controlled in the first mode by one of said flip-flops which follows said corresponding one of said flip-flops, said predetermined sample-hold circuit alternatively selecting one of the first and second sample-hold circuits of said sample-hold circuit pair in the first mode and selecting said predetermined sample-hold circuit in the second mode.

8. A signal line driving circuit for a flat-panel display device including a matrix of pixels and a plurality of signal lines for setting potentials of the pixels of respective rows, said circuit comprising:

a plurality of bus lines for receiving a plurality of color video signals;

a plurality of sample-hold circuits each connected to a bus line, for sampling and holding the color video signals on the bus lines and producing respective output voltages;

a selector for selecting for each signal line one of plural output voltages of sample-hold circuits connected to different bus lines; and a controller for sequentially enabling said plurality of sample-hold circuits.

* * * * *